United States Patent [19]

Higuchi et al.

[11] Patent Number: 4,954,050

[45] Date of Patent: Sep. 4, 1990

[54] WOBBLE PLATE TYPE COMPRESSOR WITH VARIABLE DISPLACEMENT MECHANISM

[75] Inventors: Teruo Higuchi; Kiyoshi Terauchi, both of Isesaki; Kazuhiko Takai, Maebashi; Sei Kikuchi; Hideto Kobayashi, both of Isesaki, all of Japan

[73] Assignee: Sanden Corporation, Gunma, Japan

[21] Appl. No.: 352,056

[22] Filed: May 15, 1989

Related U.S. Application Data

[62] Division of Ser. No. 157,782, Feb. 19, 1988, Pat. No. 4,875,834.

[30] Foreign Application Priority Data

Feb. 19, 1987 [JP] Japan ..... 62-36443
Feb. 19, 1987 [JP] Japan ..... 62-36444

[51] Int. Cl.[5] ..... F04B 27/08
[52] U.S. Cl. ..... 417/269
[58] Field of Search ..... 417/269, 222 S; 74/60

[56] References Cited

U.S. PATENT DOCUMENTS

| | | | |
|---|---|---|---|
| Re. 27,844 | 12/1973 | Olson, Jr. . | |
| 4,037,993 | 7/1977 | Roberts . | |
| 4,061,443 | 12/1977 | Black et al. . | |
| 4,073,603 | 2/1978 | Abendschein . | |
| 4,145,163 | 3/1979 | Fogelberg et al. . | |
| 4,231,713 | 11/1980 | Widdowson et al. . | |
| 4,428,718 | 1/1984 | Skinner . | |
| 4,433,596 | 2/1984 | Scalzo . | |
| 4,475,871 | 10/1984 | Roberts . | |
| 4,480,964 | 11/1984 | Skinner . | |
| 4,543,043 | 9/1985 | Roberts . | |
| 4,586,874 | 5/1986 | Hiraga et al. . | |
| 4,632,640 | 12/1986 | Terauchi . | |
| 4,669,272 | 6/1987 | Kawai et al. . | |
| 4,683,765 | 8/1987 | Miller | 417/269 X |
| 4,685,866 | 8/1987 | Takenaka et al. . | |
| 4,687,419 | 8/1987 | Suzuki et al. . | |
| 4,688,997 | 8/1987 | Suzuki et al. . | |
| 4,702,677 | 10/1987 | Takenaka et al. . | |
| 4,712,982 | 12/1987 | Inagaki et al. . | |
| 4,747,753 | 5/1988 | Taguchi . | |
| 4,776,259 | 10/1988 | Takai | 417/269 X |
| 4,778,348 | 10/1988 | Kikuchi et al. . | |
| 4,780,059 | 10/1988 | Taguchi . | |
| 4,780,060 | 10/1988 | Terauchi . | |
| 4,850,810 | 7/1989 | Higuchi et al. . | |
| 4,872,815 | 10/1989 | Takai . | |
| 4,878,817 | 11/1989 | Kikuchi et al. . | |

FOREIGN PATENT DOCUMENTS

| | | |
|---|---|---|
| 3545581 | 7/1986 | Fed. Rep. of Germany . |
| 3603931 | 8/1986 | Fed. Rep. of Germany . |
| 58-158382 | 9/1983 | Japan . |
| 2153922 | 1/1985 | United Kingdom . |

*Primary Examiner*—Leonard E. Smith
*Attorney, Agent, or Firm*—Banner, Birch, McKie & Beckett

[57] ABSTRACT

A wobble plate type compressor with a variable displacement mechanism including a compressor housing is disclosed. A cylinder block including a plurality of cylinders is disposed in said compressor housing and a crank chamber is formed between the end of said cylinder block and a front end plate. An inclined plate is attached to a cam rotor which is further attached to a drive shaft. Rotational motion of the drive shaft is converted by the cam rotor and the inclined plate into nutational motion of the wobble plate. A plurality of pistons are coupled to the wobble plate with each piston being reciprocably fitted within a respective one of the cylinders. A rotation preventing mechanism includes a guide plate disposed at the bottom of the compressor housing, parallel with the drive shaft. A cylindrical block is rotatably disposed within a hole formed in an extended portion of the wobble plate. The cylindrical block is secured in the hole and includes a vertical groove at its lower end which is slidably fitted on the upper end of the guide plate. A variety of means of are provided to secure the cylindrical block in the hole of the wobble plate. In a further embodiment, the guide plate is rotatably disposed within holes in the front end plate and the cylinder block to allow it to easily adapt to the inclination angle of the wobble plate.

1 Claim, 11 Drawing Sheets

WOBBLE PLATE TYPE COMPRESSOR WITH VARIABLE DISPLACEMENT MECHANISM

This application is a division of application Ser. No. 157,782, filed Feb. 19, 1988, now U.S. Pat. No. 4,875,834.

BACKGROUND OF THE INVENTION

1. Field of the Invention

This invention relates to a wobble plate type compressor with a variable displacement mechanism, and more particularly, to a rotation preventing mechanism for a wobble plate type compressor.

2. Description of the Prior Art

Wobble plate type compressors in which pistons are reciprocated in cylinders by conversion of rotational motion of a cam rotor into nutational motion of a wobble plate are well known in the art. The displacement volume of the cylinders depends upon the stroke length of the pistons which is dependent upon the inclination angle of the wobble plate. Rotation preventing mechanisms which allow nutational motion of the wobble plate are also well known in the art such as the one disclosed in Japanese Patent Application Publication No. 56-77578.

FIG. 1 shows a rotation preventing mechanism including guide bar 100 which would extend within a crank chamber in a compressor housing. Guide bar 100 would be disposed in parallel to a drive shaft between the outer perimeter of the wobble plate and the inner surface of the compressor housing. Hollow bearing 101 is slidably disposed on guide bar 100 and has a dome-shaped outer surface. A pair of semi-cylindrical shoe members 102 would be slidably disposed in the radial direction within a hole near the outer perimeter of the wobble plate and are also slidably disposed on the dome-shaped surface of hollow bearing 101. The components of the rotation preventing mechanism are assembled into the compressor housing with hollow bearing 101 retained between semi-cylindrical shoe members 102. Shoe members 102 are easily dislodged from the hole in the wobble plate, increasing the difficulty and time needed to assemble the parts of the rotation preventing mechanism into the compressor.

SUMMARY OF THE INVENTION

It is an object of this invention to provide a wobble plate type compressor with a variable displacement mechanism including a rotation preventing mechanism which can be easily and quickly assembled in the compressor housing.

It is another object of this invention to provide a wobble plate type compressor with a variable displacement mechanism including a rotation preventing mechanism of simple construction.

It is still another object of the invention to provide a wobble plate type compressor with a variable displacement mechanism including a durable rotation preventing mechanism.

These objects are accomplished by providing a wobble plate type compressor with a variable displacement mechanism including a compressor housing having a cylinder block provided with a plurality of cylinders formed therein and a crank chamber adjacent the cylinder block. A drive shaft is rotatably supported in the compressor housing. A rotor is attached to the drive shaft and is connected to a variably inclined plate. A wobble plate is disposed adjacent the inclined plate and rotational motion of the inclined plate is converted into nutational motion of the wobble plate. A reciprocative piston is slidably fitted within each of the cylinders. A rotation preventing mechanism prevents rotation of the wobble plate and includes a guide plate extending within the crank chamber. A hole is formed near the outer perimeter of the wobble plate and a cylindrical block is rotatably disposed therein. The block is secured in the hole and includes a vertical groove at its outer end with respect to the wobble plate which slidably fits around the guide plate. The cylindrical block allows reciprocating motion of the wobble plate along the guide plate but rotational motion of the wobble plate is prevented.

Further objects, features and other aspects of this invention will be understood from the following detailed description of the preferred embodiments of this invention with reference to the attached drawing figures.

DESCRIPTION OF THE PREFERRED EMBODIMENTS

Figure 2:
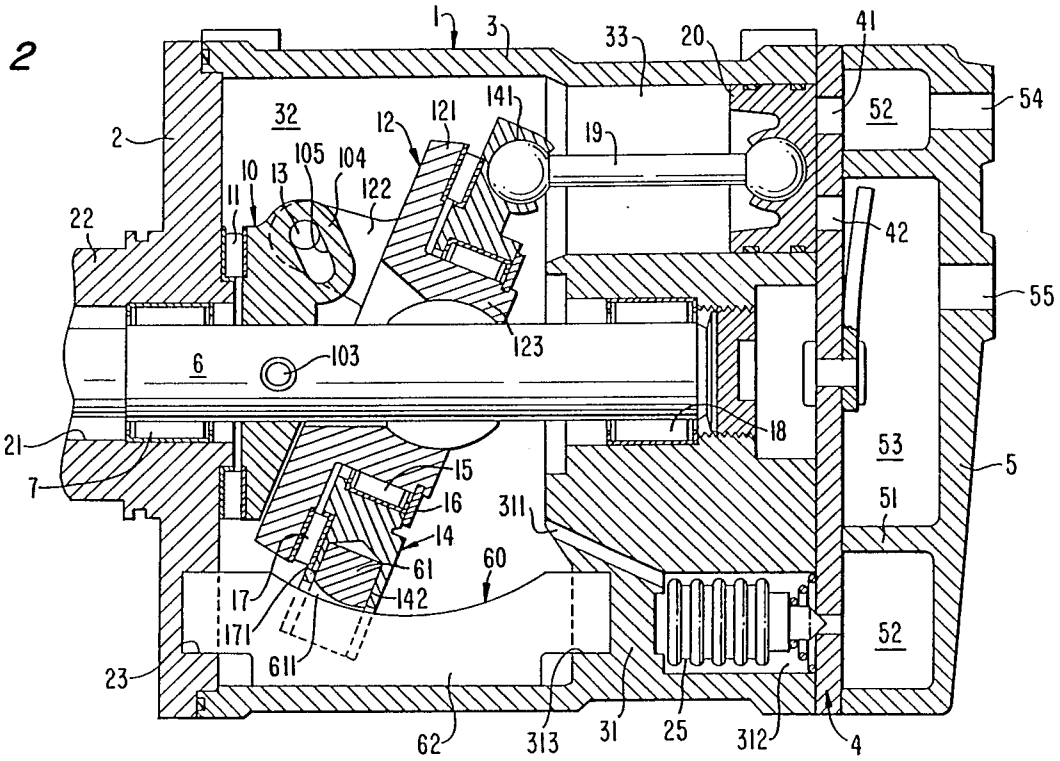
FIG. 2 is a cross-sectional view of a wobble plate type compressor with a variable displacement mechanism including a rotation preventing mechanism in accordance with a first embodiment of this invention.

Referring to FIG. 2, wobble plate type compressor 1 includes front end plate 2 fixed on one end of cylinder casing 3 by securing bolts (not shown.) Cylinder head 5 is fixed to the other end of cylinder casing 3 with valve plate 4 therebetween. Cylinder casing 3 including cylinder block 31 which further includes a plurality of equiangularly spaced cylinders 33 formed therein. Crank chamber 32 is formed between cylinder block 31, the exterior walls of cylinder casing 3 and front end plate 2. Axial hole 21 is formed through the center of front end plate 2 and drive shaft 6 extends therethrough into crank chamber 32. Radial bearing 7 is disposed in axial hole 21 and rotatably supports drive shaft 6 therein. Annular sleeve portion 22 extends from the exterior surface of front end plate 2 and surrounds drive shaft 6, defining a seal cavity (not shown).

Cam rotor 10 is fixed on drive shaft 6 by pin 103. Thrust needle bearing 11 is disposed between the inner surface of front end plate 2 and the adjacent axial end surface of cam rotor 10. Arm portion 104 of cam rotor 10 extends towards cylinder block 31 and includes elongated hole 105. Inclined plate 12 includes cylindrical portion 123 disposed around drive shaft 6. Inclined plate 12 further includes flange portion 121 and second arm portion 122 formed on the outer surface thereof. Second arm portion 122 is adjacent arm portion 104 of cam rotor 10. A hole (not shown) is formed in arm portion 122 and is aligned with elongated hole 105. Pin 13 is inserted through the hole of arm portion 122 and is slidably movable within elongated hole 105.

Wobble plate 14 is ring shaped and is mounted on the outer surface of cylindrical portion 123 of inclined plate 12 with radial bearing 15 therebetween. Axial movement of wobble plate 14 is prevented by flange portion 121 and snap ring 16 disposed on cylindrical portion 123. Thrust needle bearing 17 is disposed in a gap between flange portion 121 and wobble plate 14. Drive shaft 6 is rotatably supported at its interior end in a central bore of cylinder block 31 by radial bearing 18. One end of each piston rod 19 is rotatably connected to receiving surface 141 of wobble plate 14 and the other end of each piston rod 19 is rotatably connected to each piston 20 which are slidably fitted within cylinders 33.

Suction ports 41 and discharge ports 42 are formed through valve plate 4. A suction reed valve (not shown) and a discharge reed valve (not shown) are disposed on opposite sides of valve plate 4. Cylinder head 5 is connected to cylinder casing 3 through gaskets (not shown) and valve plate 4. Partition wall 51 extends axially from the interior surface of cylinder head 5 and divides the interior of cylinder head 5 into discharge chamber 53 and annular suction chamber 52 disposed around discharge chamber 53. Suction chamber 52 and discharge chamber 53 are connected to the external fluid circuit through fluid inlet port 54 and fluid outlet port 55 formed in cylinder head 5, respectively.

Conduit 311 is formed within cylinder block 31 and links crank chamber 32 to hollow portion 312 formed in cylinder block 31. Hole 43 is formed through valve plate 4 to allow fluid to flow from crank chamber 32 to suction chamber 52 via hollow portion 312. Control valve 25 is disposed within hollow portion 312 and controls the opening and closing of hole 43 in response to the fluid pressure in crank chamber 32.

The angle of inclined plate 12 and wobble plate 14 is dependent upon the fluid pressure in crank chamber 32. If control valve 25 closes hole 43 to prevent communication between crank chamber 32 and suction chamber 52, then the fluid pressure in crank chamber 32 gradually increases. The high fluid pressure in crank chamber 32 acts on the rear surfaces of pistons 20 to reduce the angle of inclination of inclined plate 12 and wobble plate 14 and thus the capacity of the compressor is also reduced. If communication between suction chamber 52 and crank chamber 32 is allowed by the operation of control valve 25, then fluid pressure in crank chamber 32 is gradually reduced to thereby increase the angle of inclination of inclined plate 12 and wobble plate 14, and thus the capacity of the compressor is also increased. Rotation preventing mechanism 60 is disposed within crank chamber 32 between front end plate 2 and cylinder block 31.

Figure 1:
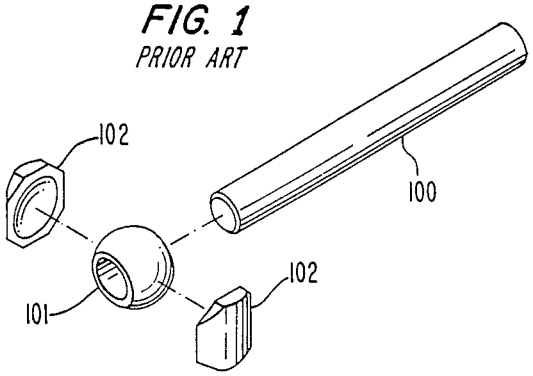
FIG. 1 PRIOR ART
FIG. 1 is an exploded perspective view showing components of a rotation preventing mechanism for a wobble plate type compressor with a variable displacement mechanism according to the prior art.
Figure 3:
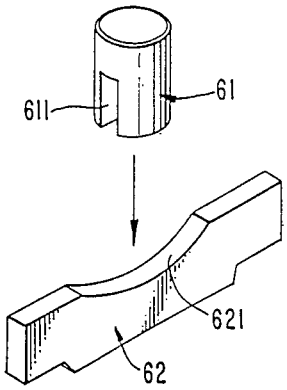
FIG. 3 is an exploded perspective view showing components of the rotation preventing mechanism of the wobble plate type compressor shown in FIG. 2.
Figure 4A:
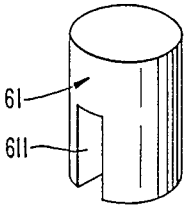
FIG. 4*a* is a perspective view of a cylindrical block included in the rotation preventing mechanism shown in FIG. 3.
Figure 4B:
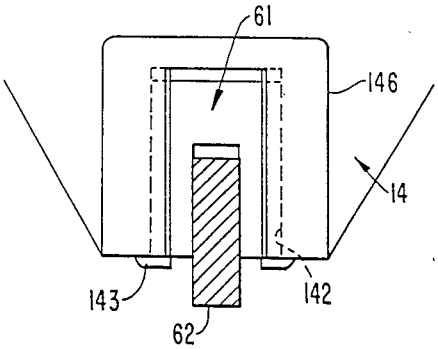
FIG. 4*b* is a front view of the rotation preventing mechanism shown in FIGS. 2 and 3.
Figure 4C:
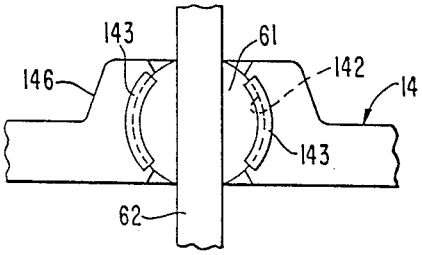
FIG. 4*c* is a bottom view of the rotation preventing mechanism shown in FIG. 4*b*.

Referring to FIGS. 2, 3, 4*a*, 4*b* and 4*c*, the construction of rotation preventing mechanism 60 is shown. Rotation preventing mechanism 60 includes cylindrical block 61 provided with vertical groove 611, and guide plate 62. The upper surface of guide plate 62 includes two flat regions on either side and arc region 621 extending therebetween. As shown in FIGS. 2 and 4*b*, cylindrical block 61 is disposed in hole 142 formed in extended portion 146 of wobble plate 14 at its lower end. Cylindrical block 61 is rotatable in hole 142 and is secured therein by caulking portion 143 which extends into hole 142 from the lower end of extended portion 146. Caulking portion 143 extends partially around the outer surface of cylindrical block 61 on either side of guide plate 62. Guide plate 62 extends in parallel to drive shaft 6 within crank chamber 32. One end of guide plate 62 is disposed in hole 313 formed in the surface of cylinder block 31 and the opposite end of guide plate 62 is disposed in hole 23 formed in the interior surface of front end plate 2. Guide plate 62 is secured within each hole.

During the assembly of compressor 1, one end of guide plate 62 is inserted into hole 313 of cylinder block 31. Cylindrical block 61 is disposed in hole 142 of wobble plate 14 and secured by caulking 143, and slidably disposed on arc region 621 of guide plate 62 via vertical groove 611. Simultaneously, the assembly including wobble plate 14, cylindrical block 61, and inclined plate 12 is disposed in the compressor housing 3. The remaining parts are assembled within compressor housing 3 thereafter. Finally, front end plate 2 is attached to compressor housing 3 and the other end of guide plate 62 is simultaneously inserted into hole 23 of front end plate 2. Therefore, cylindrical block 61 will not be dislodged from hole 142 at the time of assembly of compressor 1.

Figure 5B:
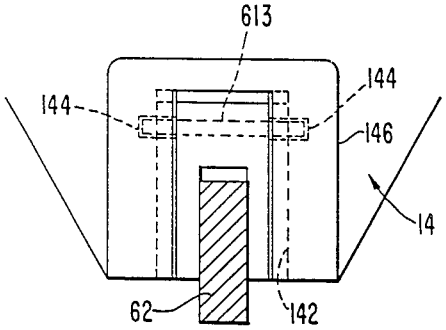
FIG. 5*b* is a front view of the rotation preventing mechanism including the cylindrical block shown in FIG. 5*a*.
Figure 5A:
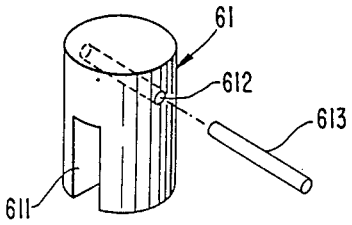
FIG. 5*a* is a perspective view of a cylindrical block forming part of a rotation preventing mechanism of a wobble plate type compressor in accordance with a second embodiment of this invention.
Figure 5C:
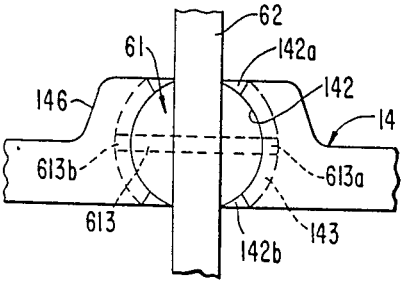
FIG. 5*c* is a bottom view of the rotation preventing mechanism shown in FIG. 5*b*.

In the embodiments shown in FIGS. 5(*a*)–13, the same reference numerals will be used for identical parts of the compressor shown in the embodiment of FIGS. 2–4(*c*).

Referring to FIGS. 5(*a*)–(*c*), a rotation preventing mechanism in accordance with a second embodiment of this invention is shown. As shown in FIG. 5(*a*), bore 612 is radially formed through an upper portion of cylindrical block 61 above vertical groove 611. Pin 613 is disposed through bore 612 with extending portions 613*a* and 613*b* on both sides. Annular groove 144 is formed on the inner cylindrical surface of hole 142 of extended portion 146 to permit pin 613 to turn therein. Openings 142*a* and 142*b* are formed on both sides of hole 142, on the axial surfaces of extended portion 146, and extend towards the bottom thereof. Both sides of bore 612 are aligned with openings 142*a* and 142*b*. Pin 613 is inserted in bore 612 and cylindrical block 61 is inserted into hole 142 until extending portions 613*a* and 613*b* of pin 613 coincide with annular groove 144. Cylindrical block 61 is rotated to move extending portions 613*a* and 613*b* along annular groove 144 away from openings 142*a* and 142*b*, and thus cylindrical block 61 is securely retained in hole 142.

Figure 6B:
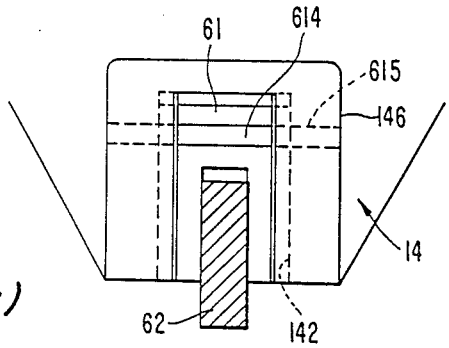
FIG. 6*b* is a front view of the rotation preventing mechanism including the cylindrical block shown in FIG. 6*a*.
Figure 6A:
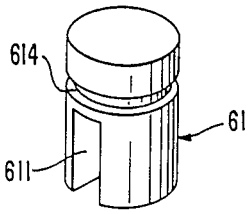
FIG. 6*a* is a perspective view of a cylindrical block forming part of a rotation preventing mechanism for a wobble plate type compressor in accordance with a third embodiment of this invention.
Figure 6C:
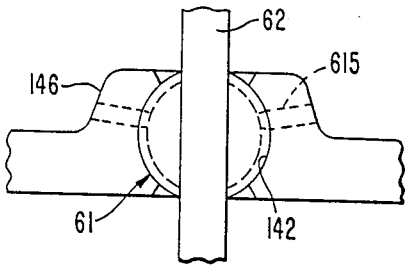
FIG. 6*c* is a bottom view of the rotation preventing mechanism shown in FIG. 6*b*.

Referring to FIGS. 6(*a*)–(*c*), a rotation preventing mechanism in accordance with a third embodiment of this invention is shown. Annular groove 614 is formed near the upper end of cylindrical block 61 along the outer surface thereof and above vertical groove 611. Radial bores 615 are formed through extended portion 146 into hole 142. After cylindrical block 61 is inserted into hole 142, a pin (not shown) is inserted into each bore 615, each pin extending within groove 614 of cylindrical block 61 to prevent radial movement thereof. Therefore, cylindrical block 61 is securely retained within hole 142.

Figure 7A:
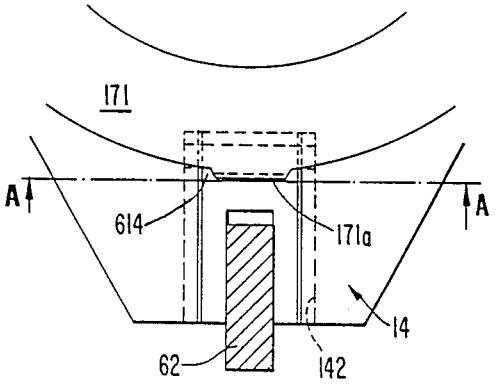
FIG. 7*a* is a front view of a rotation preventing mechanism for a wobble plate type compressor in accordance with a fourth embodiment of this invention and including the cylindrical block shown in FIG. 6*a*.
Figure 7B:
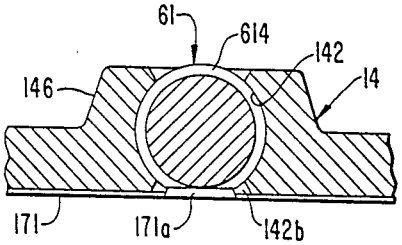
FIG. 7*b* is a cross-sectional view taken along line A—A of FIG. 7*a*.

Referring to FIGS. 7(*a*) and (*b*), a fourth embodiment of a rotation preventing mechanism, which is a modification of the mechanism shown in FIGS. 6(*a*)–(*c*) is shown. Cylindrical block 61 is provided with annular groove 614 on the outer surface thereof and is inserted into hole 42 of extended portion 146. Thrust bearing 117 includes thrust race 171 with lower end portion 171*a* adjacent extended portion 146. Opening 142*b* extends through portion 146 to hole 142. Lower end portion 171*a* extends through opening 142*b* and fits within annular groove 614 of cylindrical block 61, preventing radial movement thereof to securely retain cylindrical block 61 in hole 142.

Figure 8B:
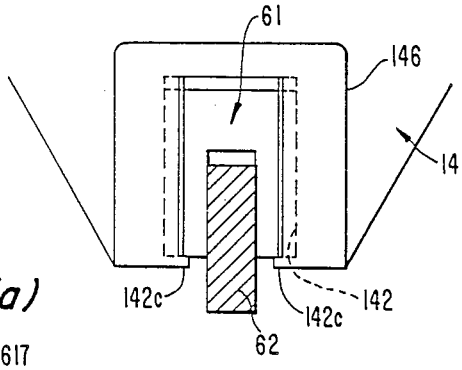
FIG. 8*b* is front view of the rotation preventing mechanism including the cylindrical block shown in FIG. 8*a*.
Figure 8A:
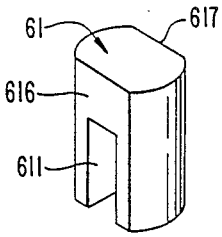
FIG. 8*a* is a perspective view of a cylindrical block forming part of a rotation preventing mechanism for a wobble plate type compressor in accordance with a fifth embodiment of this invention.
Figure 8C:
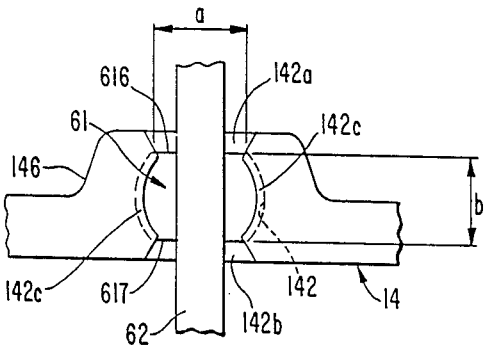
FIG. 8*c* is a bottom view of the rotation preventing mechanism shown in FIG. 8*b*.

Referring to FIGS. 8(*a*), (*b*) and (*c*), a rotation preventing mechanism in accordance with a fifth embodiment of the invention is shown. Cylindrical block 61 includes opposed planar surfaces 616 and 617 and vertical groove 611. Hole 142 of extended portion 146 includes flange portion 142*c* formed along the cylindrical surface of hole 142 at the bottom thereof. Openings 142*a* and 142*b* are formed in flange portion 142*c* and extend towards the top of hole 142. The axial width a of at least one of openings 142*a* or 142*b* is greater than the thickness b of cylindrical block 61 between opposed planar surfaces 616 and 617. Cylindrical block 61 is inserted into hole 142 through opening 142*a* and 142*b* with opposed planar surfaces 616 and 617 facing flange portion 142*c*, that is, the opposed planar surfaces are parallel to the long surfaces of guide plate 62 upon assembly. After cylindrical block 61 is fully inserted into hole 142, it is rotated so that opposed planar surfaces 616 and 617 are perpendicular to guide plate 62. Cylindrical block 61 rests on radial flange portion 142*c* to prevent radial motion thereof and to secure it within hole 142.

Figure 9A:
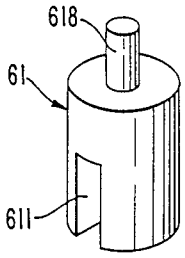
FIG. 9*a* is a perspective view of a cylindrical block forming part of a rotation preventing mechanism for a wobble plate type compressor in accordance with a sixth embodiment of this invention.
Figure 9B:
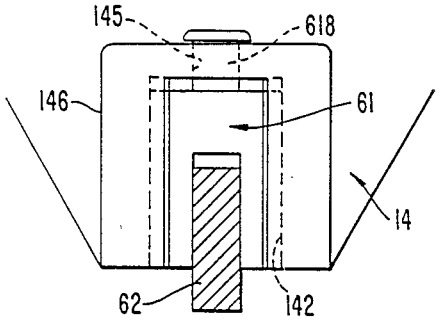
FIG. 9*b* is a front view of the rotation preventing mechanism for a wobble plate type compressor including the cylindrical block shown in FIG. 9*a*.
Figure 9C:
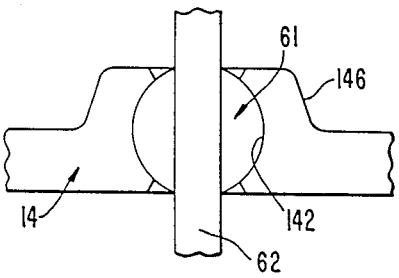
FIG. 9*c* is a bottom view of the rotation preventing mechanism shown in FIG. 9*b*.

Referring to FIGS. 9(*a*)–(*c*), a rotation preventing mechanism in accordance with a sixth embodiment of the invention is shown. Cylindrical block 61 is provided with pin 618 extending from its upper surface. Bore 145 is formed through extended portion 146 of wobble plate 14 to hole 142. Cylindrical block 61 is inserted into hole 142 and the upper end of pin 618 projects through bore 145. The upper end of pin 618 is caulked to secure cylindrical block 61 in place in hole 142.

Figure 10A:
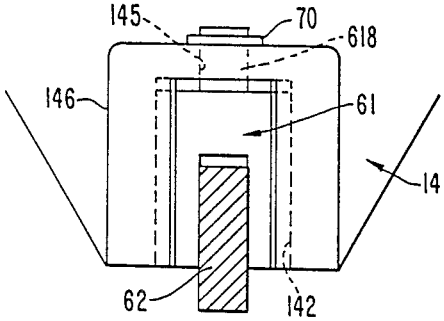
FIG. 10*a* is a front view showing a rotation preventing mechanism for a wobble plate type compressor in accordance with a seventh embodiment of this invention including the cylindrical block shown in FIG. 9*a*.
Figure 10B:
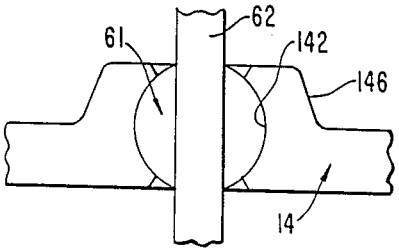
FIG. 10*b* is a bottom view of the rotation preventing mechanism shown in FIG. 10*a*.

Referring to FIGS. 10(*a*) and (*b*), a rotation preventing mechanism in accordance with a seventh embodiment of the invention, and which is a modification of the mechanism shown in FIGS. 9(*a*)–(*c*), is shown. In FIGS. 10(*a*) and (*b*), cylindrical block 61 is retained in hole 142 by snap ring 70 at the upper end of pin 618.

Figure 11A:
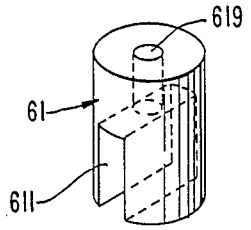
FIG. 11*a* is a perspective view of a cylindrical block forming part of a rotation preventing mechanism in accordance with an eighth embodiment of this invention.
Figure 11B:
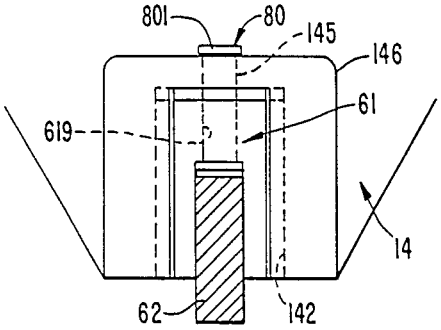
FIG. 11*b* is a front view of a rotation preventing mechanism for a wobble plate type compressor including the cylindrical block shown in FIG. 11*a*.
Figure 11C:
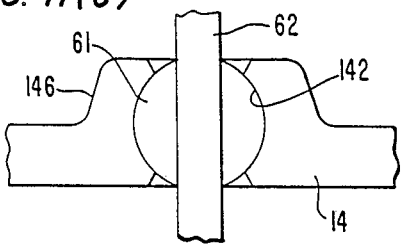
FIG. 11*c* is a bottom view of the rotation preventing mechanism shown in FIG. 11*b*.

Referring to FIGS. 11(*a*)–(*c*), a rotation preventing mechanism in accordance with an eighth embodiment of this invention is shown. Cylindrical block 61 is provided with cylindrical bore 619 formed in the upper part thereof and extending from the upper end surface of cylindrical block 61 to vertical groove 611. Pin 80 includes radial flange portion 801 at its upper end and is inserted into hole 619 through bore 145 in extended portion 146. Cylindrical block 61 is retained in hole 142 by caulking flange portion 801.

Figure 13:
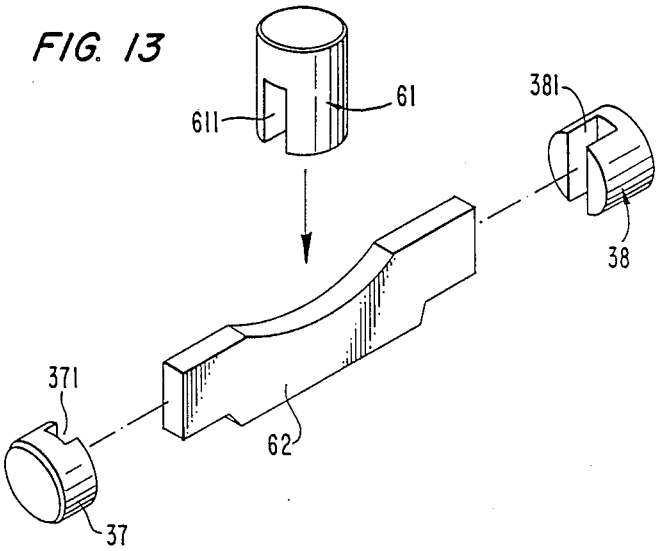
FIG. 13 is an exploded perspective view showing components of the rotation preventing mechanism included in the wobble plate type compressor shown in FIG. 12.
Figure 12:
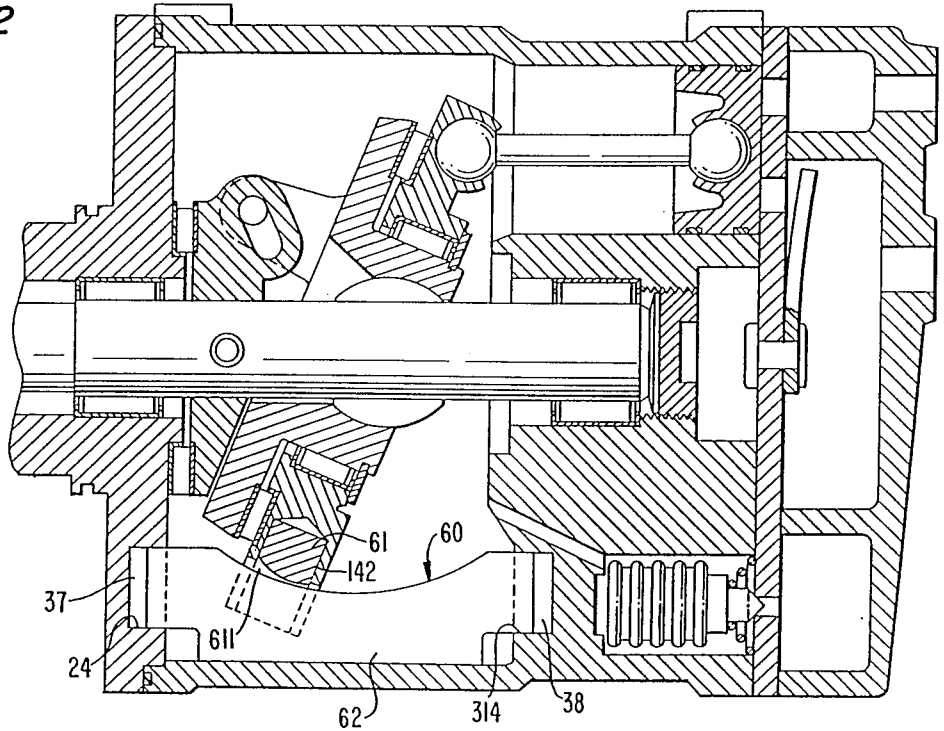
FIG. 12 is a cross-sectional view of a wobble plate type compressor with a variable displacement mechanism including a rotation preventing mechanism in accordance with a ninth embodiment of this invention.

Referring to FIGS. 12 and 13, a rotation preventing mechanism in accordance with a ninth embodiment of this invention is shown. Cylindrical block 61 is disposed within hole 142 of extended portion 146 and is movable in the radial direction. Circular disc 37 includes elongated slit 371 and is rotatably disposed in hole 24 formed on the interior surface of front end plate 2. Circular disc 38 includes elongated slit 381 and is rotatably disposed in hole 314 formed in cylinder block 31. Guide plate 62 extends within crank chamber 32 with each end fixedly disposed in elongated slits 371 and 381, respectively. Since the circular discs are rotatably disposed in their respective holes, guide plate 62 is rotatable around an axis parallel to the axis of drive shaft 6 and is adjustable in response to the change of inclination angle of wobble plate 14 to reduce abrasive contact the interior surfaces of groove 611 of cylindrical block 61 with any one side of guide plate 62. Therefore, excess abrasion of cylindrical block 61 is prevented, increasing the durability of the rotation preventing mechanism.

This invention has been described in detail with preferred embodiments. These embodiments, however, merely are for example only and this invention is not restricted thereto. It will be easily understood by those skilled in the art that variations and modifications can be easily made within the scope of the invention, as defined by the appended claims.

We claim:

1. In a wobble plate type compressor with a variable displacement mechanism, said compressor comprising a compressor housing having a cylinder block provided with a plurality of cylinders and a crank chamber adjacent said cylinder block, a front end plate attached to said housing at one end adjacent said crank chamber, a piston slidably fitted within each of said cylinders, a drive shaft rotatably supported in said housing, a rotor fixed on said drive shaft and further connected to a variably inclined plate, a wobble plate adjacent said inclined plate with each of said plurality of pistons coupled at one end with said wobble plate, rotational motion of said inclined plate being converted into nutational motion of said wobble plate, and a rotation preventing mechanism to prevent rotation of said wobble plate, the improvement comprising:

said rotation preventing mechanism comprising a pair of circular discs, each said circular disc including an elongated slit at one end surface thereof, one said disc rotatably disposed in a hole formed on an inner surface of said front end plate and the other of said discs rotatably disposed in a hole formed on the surface of said cylinder block, a guide plate extending within said crank chamber, each end surface of said guide plate disposed in one of said elongated slits of said circular discs, said circular discs and said guide plate rotatable together, and a cylindrical block disposed in a hole formed in an extended portion of said wobble plate, said cylindrical block including a vertical groove therein slidably fitted on said guide plate.

* * * * *